US007902735B2

(12) United States Patent
Guo et al.

(10) Patent No.: US 7,902,735 B2
(45) Date of Patent: Mar. 8, 2011

(54) GAS DISCHARGE TUBE, AND DISPLAY DEVICE HAVING GAS DISCHARGE TUBE ARRAYS

(75) Inventors: Bingang Guo, Kobe (JP); Hitoshi Hirakawa, Kobe (JP); Manabu Ishimoto, Kobe (JP); Yosuke Yamazaki, Kobe (JP); Kenji Awamoto, Kobe (JP)

(73) Assignee: Shinoda Plasma Co., Ltd., Kobe (JP)

( * ) Notice: Subject to any disclaimer, the term of this patent is extended or adjusted under 35 U.S.C. 154(b) by 269 days.

(21) Appl. No.: 12/232,753

(22) Filed: Sep. 23, 2008

(65) Prior Publication Data

US 2009/0273273 A1 Nov. 5, 2009

(30) Foreign Application Priority Data

Apr. 30, 2008 (JP) ..... 2008-118661

(51) Int. Cl.
*H01J 1/62* (2006.01)

(52) U.S. Cl. ..... 313/485; 313/582

(58) Field of Classification Search ..... 313/582–587, 313/485, 493; 445/24; 315/169.4; 345/60, 345/30, 37, 41, 71
See application file for complete search history.

(56) References Cited

U.S. PATENT DOCUMENTS

| | | | | |
|---|---|---|---|---|
| 6,633,117 | B2 | 10/2003 | Shinoda et al. | 313/484 |
| 6,650,055 | B2 * | 11/2003 | Ishimoto et al. | 313/623 |
| 7,339,312 | B2 | 3/2008 | Yamada et al. | 313/485 |
| 7,479,736 | B2 * | 1/2009 | Shinohe et al. | 313/582 |
| 2003/0048068 | A1 * | 3/2003 | Yamada et al. | 313/485 |
| 2003/0048077 | A1 * | 3/2003 | Ishimoto et al. | 313/623 |
| 2003/0052592 | A1 | 3/2003 | Shinoda et al. | 313/484 |
| 2005/0088091 | A1 * | 4/2005 | Tokai et al. | 313/582 |
| 2006/0038476 | A1 * | 2/2006 | Shinohe et al. | 313/485 |
| 2006/0103292 | A1 * | 5/2006 | Yamada et al. | 313/486 |
| 2006/0119247 | A1 * | 6/2006 | Tokai et al. | 313/493 |
| 2006/0175972 | A1 * | 8/2006 | Yamada et al. | 313/607 |
| 2006/0214554 | A1 * | 9/2006 | Yamazaki et al. | 313/485 |
| 2008/0024049 | A1 * | 1/2008 | Hirakawa et al. | 313/485 |
| 2009/0278437 | A1 * | 11/2009 | Yamazaki et al. | 313/485 |
| 2009/0284448 | A1 * | 11/2009 | Tamura et al. | 345/60 |

FOREIGN PATENT DOCUMENTS

| | | |
|---|---|---|
| EP | 0 518 132 A2 | 12/1992 |
| JP | 5-82101 | 4/1993 |
| JP | 6-251713 | 9/1994 |
| JP | 2003-92085 | 3/2003 |
| JP | 2006-140075 | 6/2006 |
| JP | 2006-164635 | 6/2006 |
| JP | 2006-278133 | 10/2006 |
| JP | 2006-278161 | 10/2006 |

* cited by examiner

*Primary Examiner* — Peter Macchiarolo
(74) *Attorney, Agent, or Firm* — Staas & Halsey LLP

(57) ABSTRACT

A gas discharge tube includes: a elongated tube within which an electron-emissive film is formed, and which is filled with a discharge gas and sealed; a plurality of pairs of display electrodes disposed on a display side of the elongated tube; a signal electrode disposed on a rear side of the elongated tube; and an elongated support member inserted into the elongated tube and extending in the length direction of the elongated tube. The support member has a curved shape so that a curved inner surface thereof forms a discharge space, has longitudinally extending opposite edges, and has a phosphor layer formed on the inner surface of the support member. The support member further has an end wall at each of longitudinally opposite ends thereof. The end walls and the curved inner surface form an elongated depression in the support member.

13 Claims, 6 Drawing Sheets

GAS DISCHARGE TUBE, AND DISPLAY DEVICE HAVING GAS DISCHARGE TUBE ARRAYS

CROSS-RELATED APPLICATION

This application is based upon and claims the benefit of priority of the prior Japanese Patent Application No. 2008-118661, filed on Apr. 30, 2008, the entire contents of which are incorporated herein by reference.

FIELD OF THE INVENTION

The present invention relates generally to a gas discharge tube for a display device and, more particularly, to such a gas discharge tube in which reduction of light-emission at end portions thereof is improved.

BACKGROUND OF THE INVENTION

In a known plasma display panel (PDP), plasma discharge is generated in closed discharge spaces of a large number of small cells arranged in length and width directions of the panel, and phosphor materials are excited by ultraviolet light of 147 nm emitted from the discharged plasma, to thereby emit light. The cell spaces are formed between two planar glass plates disposed one on the other. On the other hand, in a known plasma tube array (PTA), as disclosed in Japanese Patent Application Publication No. 2003-92085-A, a phosphor layer is formed within a thin, elongated glass tube in which a large number of cell spaces are formed. A large-sized display screen of 6 m×3 m, for example, can be provided by arranging a number of such plasma tubes side by side.

Japanese Patent Application Publication No. 2006-164635-A (which corresponds to US Patent Application Publication No. 2006/119247 A1) describes a method of manufacturing a gas discharge tube for a display device. In this method, an opening of a glass tube is closed by forming a glass layer with outer peripheral shape identical to the outer peripheral shape of the glass tube on an end face of the glass tube. An open end face of the glass tube is pressure-welded to a dry film containing a low-melting-point glass powder and a binder resin. The glass tube is then lifted up to transfer the dry film portion to the end face of the glass tube, to thereby close the opening of the glass tube. A phosphor support member is inserted into the glass tube through an opening on a side opposite to the end face and then an end of the phosphor support member is adhered to the dry film portion. The binder resin is burnt off, and the dry film is vitrified to produce a low-melting-point glass layer.

Japanese Patent Application Publication No. 2006-140075-A describes a method of manufacturing a gas discharge tube and a display device. The gas discharge tube includes a thin tube having a discharge space therein and an electron emissive coating formed within the thin tube. The thin tube has a display surface on which a pair of display electrodes is adapted to be disposed, and has a rear surface on which a signal electrode is adapted to be disposed. A surface portion facing toward the display surface is formed within the thin tube at a location nearer to the display surface from the midway between the display and rear surfaces. An electron emissive coating is formed on the surface portion. Thus the gas discharge tube can reduce its firing voltage.

SUMMARY OF THE INVENTION

In accordance with an aspect of an embodiment, a gas discharge tube includes: an elongated tube within which an electron-emissive film and a phosphor layer are formed, and which is filled with a discharge gas and sealed; a plurality of pairs of display electrodes disposed on a display side of the elongated tube; a signal electrode disposed on a rear side of the elongated tube; and an elongated support member inserted into the elongated tube and extending in the length direction of the elongated tube. The support member has a curved shape so that a curved inner surface thereof forms a discharge space, has longitudinally extending opposite edges, and has a phosphor layer formed on the inner surface of the support member. The support member further has an end wall at each of longitudinally opposite ends thereof. The end walls and the curved inner surface form an elongated depression in the support member.

In accordance with another aspect of the embodiment, a display device includes a plurality of such gas discharge tubes as above-described.

Additional objects and advantages of the embodiment will be set forth in part in the description which follows, and in part will be obvious from the description, or may be learned by practice of the invention. The object and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

DESCRIPTION OF THE PREFERRED EMBODIMENTS

The invention will be described in connection with non-limiting embodiments with reference to the accompanying drawings. Throughout the drawings, similar symbols and numerals indicate similar items and functions.

It is not practical to manufacture a large-sized plasma display device by the use of a single, large-sized array of plasma tubes arranged between front and rear support plates. A large-sized display device may be advantageously manufactured relatively easily by arranging, side by side, a plurality of separate or divided plasma tube array units or modules and by assembling the plasma tube array units.

The inventors have recognized that brightness or luminosity of a displayed image is lowered at end portions of plasma or gas discharge tubes near the seams or joints between adjacent arrays of plasma tubes.

An object of the present invention is to suppress the lowering of luminosity in the vicinity of end portions of gas discharge tubes.

According to the invention, the lowering of luminosity in the vicinity of end portions of gas discharge tubes can be suppressed.

Figure 1:
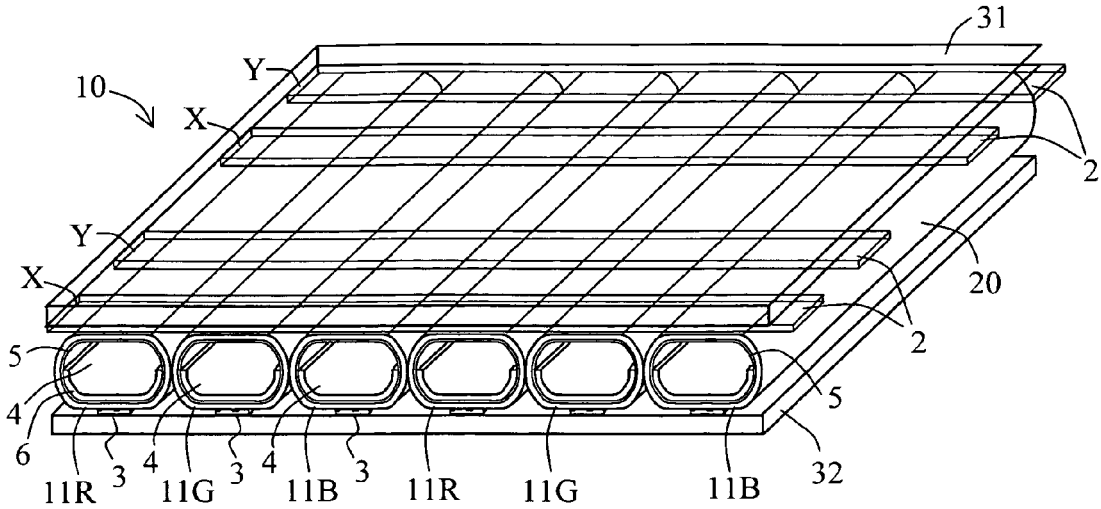
FIG. 1 illustrates an example of a schematic structure of part of an array of plasma tubes or gas discharge tubes of a color display device.

FIG. 1 illustrates an example of a schematic structure of part of an array of plasma tubes or gas discharge tubes 11R, 11G and 11B of a color display device 10. In FIG. 1, the display device 10 includes an array of thin, elongated transparent color plasma tubes 11R, 11G, 11B, . . . , disposed in parallel with each other, a front support plate 31 composed of a transparent front support sheet or thin plate, a rear support plate 32 composed of a transparent or opaque rear support sheet or thin plate. The display device 10 further includes a plurality of pairs of display or main electrodes 2, and a plurality of signal or address electrodes 3. In FIG. 1, a letter X represents a sustain or X electrode of the display electrodes 2, and a letter Y represents a scan or Y electrode of the display electrodes 2. Letters R, G and B represent red, green and blue, which are colors of light emitted by the phosphors. The front and rear support plates 31 and 32 are made of, for example, flexible or elastic PET or glass films or sheets.

A thin elongated tube 20 for the thin elongated plasma tubes 11R, 11G and 11B is formed of a transparent, insulating material, e.g. borosilicate glass, Pyrex®, soda-lime glass, silica glass, or Zerodur. Typically, the tube 20 has cross-section dimensions of a tube diameter of 2 mm or smaller, for example a 0.55 mm high and 1 mm wide cross section, and a tube length of 300 mm or larger, and a tube wall thickness of about 0.1 mm.

Phosphor support members having respective red, green and blue (R, G, B) phosphor layers 4 formed or deposited thereon are inserted into the interior rear spaces of the plasma tubes 11R, 11G and 11B, respectively. Discharge gas is introduced into the interior space of each plasma tube, and the plasma tube is sealed at its opposite ends. An electron emissive film 5 of MgO is formed on the inner surface of the plasma tube 11R, 11G, 11B. The phosphor layers R, G and B typically have a thickness within a range of from about 10 μm to about 30 μm.

The support member 6 has generally a shape of a trough or boat having a generally U-shaped or C-shaped transverse cross-section. Similarly to the plasma tubes 11R, 11G and 11B, the support member 6 is formed of a insulating material, e.g. borosilicate glass, Pyrex®, silica glass, soda-lime glass, or lead glass, and has the phosphor layer 4 formed thereon. The support member 6 can be disposed within the glass tube by applying a paste of phosphor over the support member 6 outside the glass tube and then baking the phosphor paste to form the phosphor layer 4 on the support member 6, and then inserting the support member 6 into the glass tube. As the phosphor paste, a desired one of various phosphor pastes known in this technical field may be employed.

The electron emissive film 5 emits charged particles, when it is bombarded with the discharge gas. When a voltage is applied between the pair of display electrodes 2, the discharge gas contained in the tube is excited. The phosphor layer 4 emits visible light by converting thereinto vacuum ultraviolet radiation generated in the de-excitation process of the excited rare gas atoms.

Figure 2A:
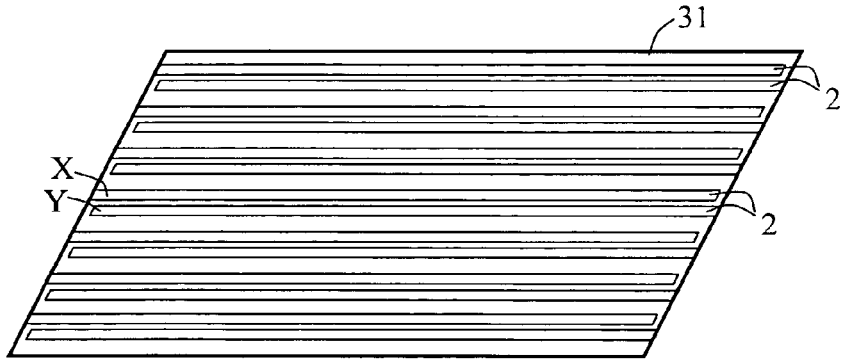
FIG. 2A illustrates a front support plate with a plurality of pairs of transparent display electrodes formed thereon.
Figure 2B:
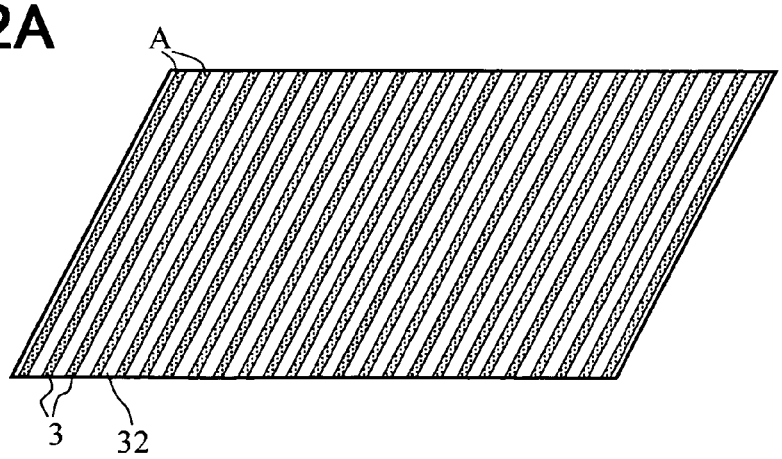
FIG. 2B illustrates a rear support plate with a plurality of signal electrodes formed thereon.

FIG. 2A illustrates the front support plate 31 with the plurality of pairs of transparent display electrodes 2 formed thereon. FIG. 2B illustrates the rear support plate 32 with the plurality of signal electrodes 3 formed thereon.

The signal electrodes 3 are formed on the front-side surface, or inner surface, of the rear support plate 32, and extend along the longitudinal direction of the plasma tubes 11R, 11G and 11B. The pitch, between adjacent ones of the signal electrodes 3, is equal to the width of each of the plasma tubes 11R, 11G and 11B, which may be, for example, 1 mm. The pairs of display electrodes 2 are formed on the rear-side surface, or inner surface, of the front support plate 31 in a well-known manner, and are disposed so as to extend perpendicularly to the signal electrodes 3. The width of the display electrode 2 may be, for example, 0.75 mm, and the distance between the edges of the display electrodes 2 in each pair may be, for example, 0.4 mm. A distance providing a non-discharging region, or non-discharging gap, is secured between one display electrode pair 2 and the adjacent display electrode pairs 2, and the distance may be, for example, 1.1 mm.

The signal electrodes 3 and the pairs of display electrodes 2 are brought into intimately contact respectively with the lower and upper peripheral surface portions of the plasma tubes 11R, 11G and 11B, when the display device 10 is assembled. In order to provide better contact, an electrically conductive adhesive may be placed between the display electrodes and the plasma tube surface portions.

In plan view of the display device 10 seen from the front side, the intersections of the signal electrodes 3 and the pairs of display electrodes 2 provide unit light-emitting regions. Display is provided by using either one electrode of each pair of display electrodes 2 as a scan electrode, generating a selection discharge at the intersection of the scan electrode with the signal electrode 3 to thereby select a light-emitting region, and generating a display discharge between the pair of display electrodes 2 using the wall charge formed by the selection discharge on the region of the inner tube surface at the selected region, which, in turn, causes the associated phosphor layer to emit light. The selection discharge is an opposed discharge generated within each plasma tube 11R, 11G, 11B between the vertically opposite scan electrode and signal electrode 3. The display discharge is a surface discharge generated within each plasma tube 11R, 11G and 11B between the two display electrodes of each pair of display electrodes disposed in parallel in a plane.

The pair of display electrodes 2 and the signal electrode 3 can generate discharges in the discharge gas within the tube by applying voltages between them. The electrode structure of the plasma tubes 11R, 11G and 11B illustrated in FIG. 1 is such that the three electrodes are disposed in one light-emitting region, and that the discharge between the pair of display electrodes generates a discharge for display. However, the electrode structure is not limited to such a structure. A display discharge may be generated between the display electrode 2 and the signal electrode 3. In other words, an electrode structure of a type employing a single display electrode may be employed instead of each pair of display electrodes 2, in which the single display electrode 2 is used as a scan electrode so that a selection discharge and a display discharge (opposed discharge) are generated between the single display electrode 2 and the signal electrode 3.

Figure 3:
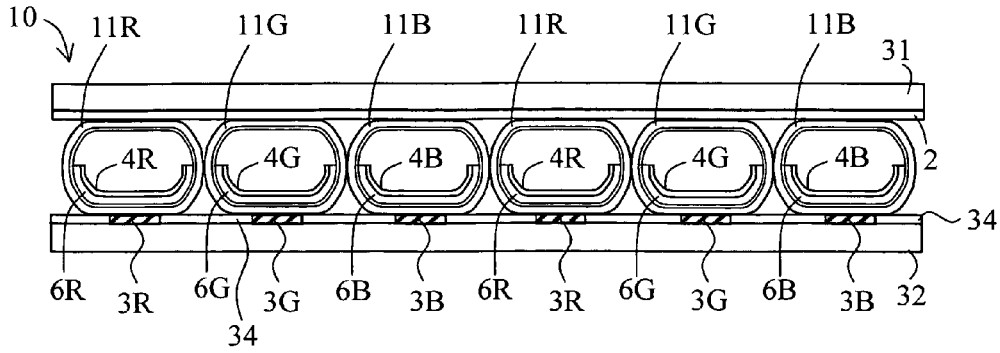
FIG. 3 illustrates a cross-sectional view of the structure of the array of plasma tubes of the display device in a plane perpendicular to the longitudinal direction.

FIG. 3 illustrates the cross-section of the structure of the array of plasma tubes 11 of the display device 10 in a plane perpendicular to the longitudinal direction. In the display device 10, phosphor layers 4R, 4G and 4B are formed on the inner surface portions of the support members 6R, 6G and 6B in the rear-half spaces of the plasma tubes 11R, 11G and 11B, respectively. The plasma tubes are thin tubes having a tube thickness of 0.1 mm, a width in the cross-section of 1.0 mm, a height in the cross-section of 0.55 mm, and a length of from 1 m to 3 m. For example, the red-emitting phosphor 4R may be formed of an yttria based material ($(Y.Ga)BO_3$:Eu), the green-emitting phosphor 4G may be formed of a zinc silicate based material ($Zn_2SiO_4$:Mn), and the blue-emitting phosphor 4B may be formed of a BAM based material ($BaMgAl_{10}O_{17}$:Eu).

In FIG. 3, the rear support plate 32 is bonded or fixed to bottom surfaces of the red-emitting plasma tubes 11R, 11G and 11B. The signal electrodes 3R, 3G and 3B are disposed on the bottom surfaces of the plasma tubes 11R, 11G and 11B and on an upper surface of the rear support plate 32.

Figure 4:
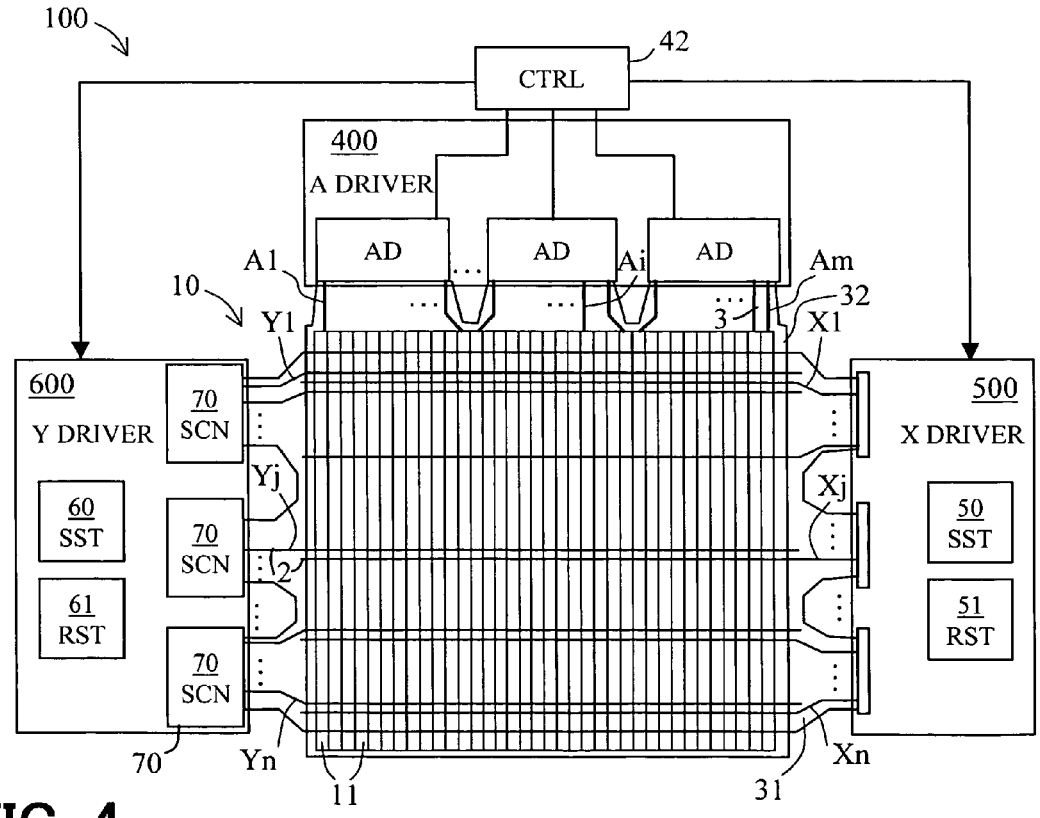
FIG. 4 illustrates a display device of a plasma tube array type, which includes a plasma tube array (PTA) unit, an address (A-) electrode driver unit, an X-electrode driver unit, and a Y-electrode driver unit.

FIG. 4 illustrates a display device 100 of a plasma tube array type, which includes a plasma tube array (PTA) unit 300, an address (A-) electrode driver unit 400, an X-electrode driver unit 500, and a Y-electrode driver unit 600. The PTA unit 300 has n pairs of display electrodes 2, (X1, Y1), . . . , ((Xj, Yj), . . . , (Xn, Yn). X-electrodes of the pairs of display electrodes 2 are connected to a sustain voltage pulse circuit (SST) 50 for the X-electrodes in the X-electrode driver unit 500. Y-electrodes of the pairs of display electrodes 2 are connected to scan pulse circuits (SCNs) 70 in the Y-electrode driver unit 600. The PTA unit 300 has also a plurality, m, of signal electrodes 3, A1, . . . , Ai, . . . , Am, which are connected to the A-electrode driver unit 400. The X-electrode driver unit 500 includes also a reset circuit (RST) 51. The Y-electrode driver unit 600 includes also a sustain voltage pulse circuit (SST) 60 and a reset circuit (RST) 61. A driver control circuit (CTRL) 42 is connected to the A-electrode driver unit 400, the X-electrode driver circuit 500, and the Y-electrode driver unit 600.

Now, one exemplary method for driving an AC gas discharge display device of the plasma tube array type is described. One picture typically has one frame period. One frame consists of two fields in the interlaced scanning scheme, and one frame consists of one field in the progressive scanning scheme. For displaying a moving picture in a conventional television system, thirty or sixty frames per second must be displayed. In displaying on the display device 10 of this type of AC gas discharge display device, for reproducing colors by the binary control of light emission, one field F is typically divided into or replaced with a set of q subfields SF's. Often, the number of times of discharging for display for each subfield SF is set by weighting these subfields SF's with respective weighting factors of $2^0, 2^1, 2^2, \ldots, 2^{q-1}$ in this order. N $(=1+2^1+2^2+\ldots+2^{q-1})$ steps of brightness can be provided for each color of R, G and B in one field by associating light emission or non-emission with each of the subfields in combination. In accordance with such a field structure, a field period Tf, which represents a cycle of transferring field data, is divided into q subfield periods Tsf's, and the subfield periods Tsf's are associated with respective subfields SF's of data. Furthermore, a subfield period Tsf is divided into a reset period TR for initialization, an address period TA for addressing, and a display or sustain period TS for emitting light. Typically, the lengths of the reset period TR and the address period TA are constant independently of the weighting factors for the brightness, while the number of pulses in the display period TS becomes larger as the weighting factor becomes larger, and the length of the display period TS becomes longer as the weighting factor becomes larger. In this case, the length of the subfield period Tsf becomes longer, as the weighting factor of the corresponding subfield SF becomes larger.

Figure 5:
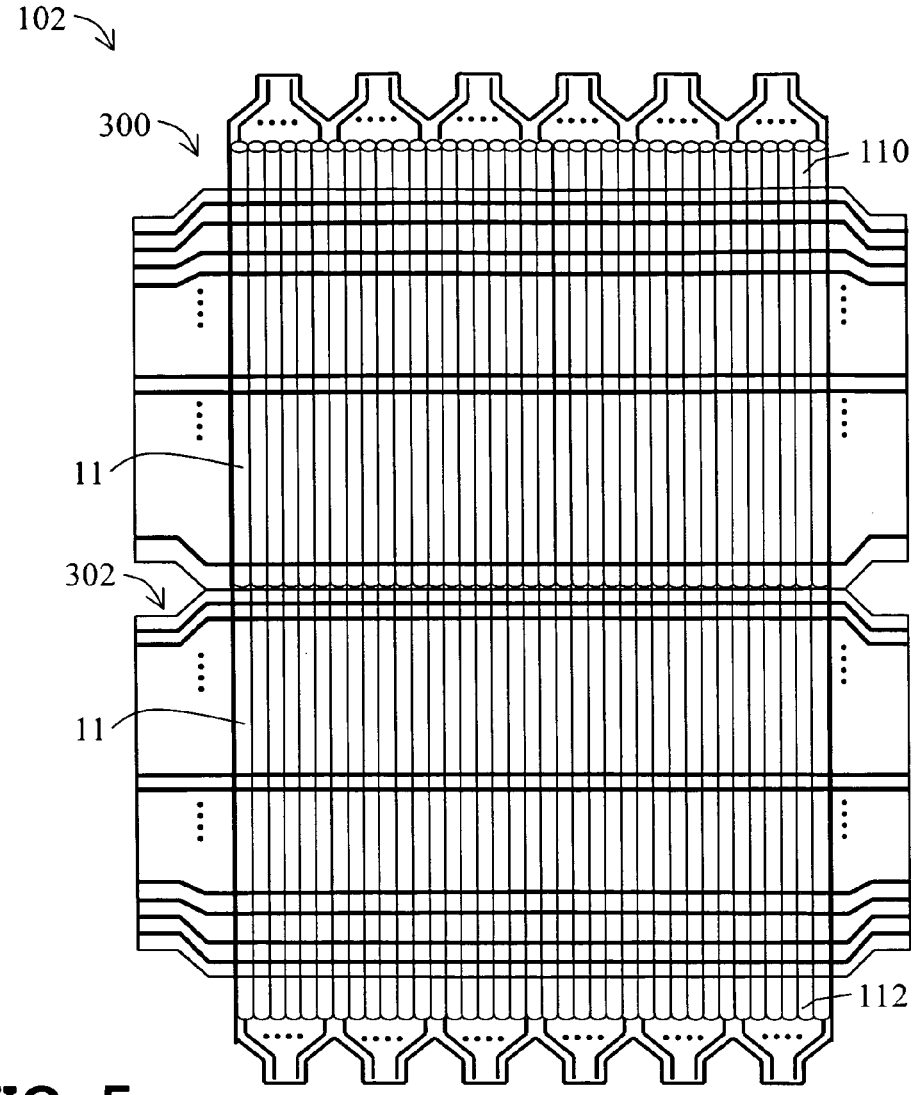
FIG. 5 illustrates two of plasma tube array (PTA) units assembled into a display device.

FIG. 5 illustrates two (300 and 302) of plasma tube array (PTA) units assembled into a display device 102. The PTA units 300 and 302 are arranged such that the lower ends of vertically extending plasma tubes 110 of the PTA unit 300 contact the upper ends of corresponding, vertically extending plasma tubes 112 of the PTA unit 302.

The inventors have discovered that the brightness at the ends of the plasma tubes or gas discharge tubes 11, 110, 112 tends to be lower. The inventors have recognized that lowering of brightness or image artifacts in the vicinity of the seam or joint between the adjacent PTA units 300 and 302 can be suppressed by preventing the lowering of brightness at the ends of the plasma tubes.

The inventors have also discovered that, when plasma tubes or PTA units are being handled during manufacture and/or transportation thereof, part of phosphor layers formed on support members at the ends of the plasma tubes may be peeled off due to contacting with, rubbing against, or impacting on other members. The inventors have further recognized that little or almost no light can be emitted from discharge cells lacking phosphors in end portions of the plasma tubes even when discharge occurs in inner discharge spaces of the plasma tubes.

The inventors have further recognized that, in discharge cells lacking part of phosphors at end portions of plasma tubes, discharge conditions, such as charging characteristics and inter-line capacitance, may change, which causes a firing voltage to increase. The inventors have further recognized that discharge cells in end portions of plasma tubes having higher firing voltage than other discharge cells may fail to discharge or, otherwise, emit little light.

Figure 6:
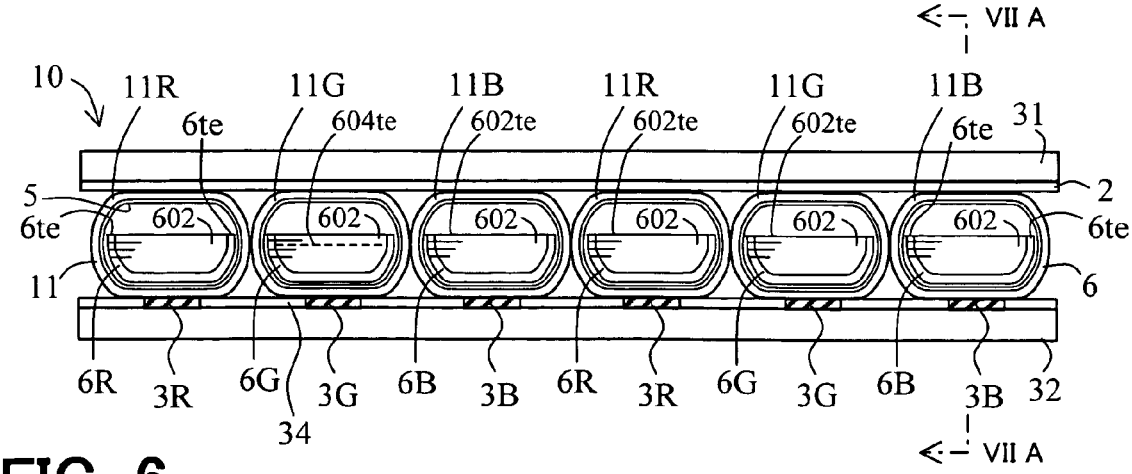
FIG. 6 is a bottom view of an array of plasma tubes (PTA), in accordance with an embodiment of the present invention.

FIG. 6 is a bottom view of an array of plasma tubes (PTA) 11, including plasma tubes 11R, 11G and 11B, in accordance with an embodiment of the present invention. The array of plasma tubes 11 illustrated in FIG. 6 corresponds to the one illustrated in FIG. 3. In FIG. 6, the array of plasma tubes 11 is illustrated with its outer wall at the bottom end removed for ease of explanation. Each of the plasma tubes 11 in FIG. 6 is illustrated in its cross-section along a line VI-VI through a plasma tube 11 illustrated in FIG. 7A and 7B.

Generally semicircular or semi-elliptical end walls 602 with respective generally U-shaped or C-shaped edges are secured to longitudinally opposite ends of a support member 6 (6R, 6G or 6B) disposed within each plasma tube 11.

Figure 7A:
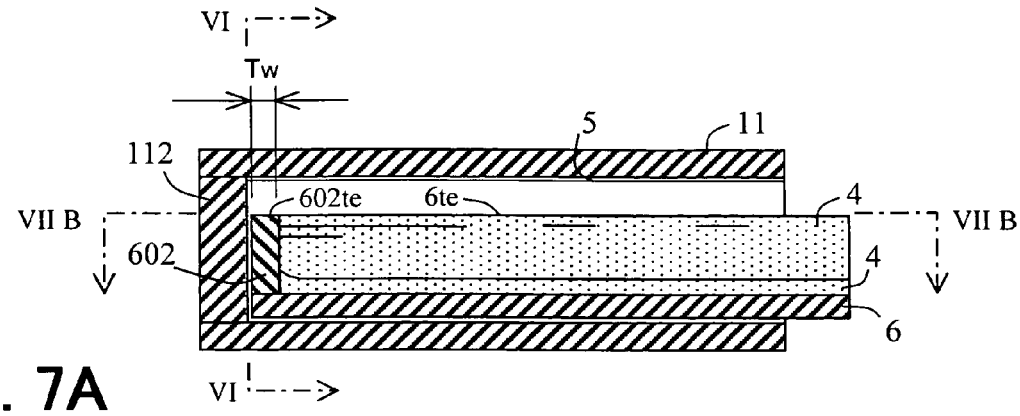
FIG. 7A is a cross-sectional view of part of one of plasma tube or gas discharge tubes of FIG. 6 along a line VIIA-VIIA in FIG. 6.
Figure 7B:
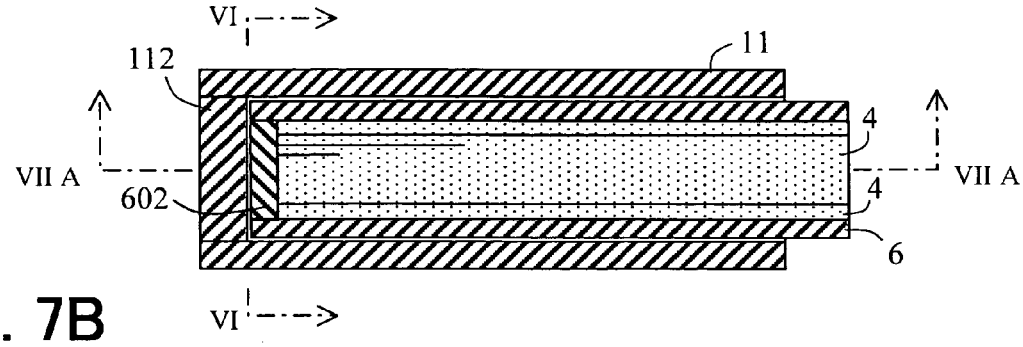
FIG. 7B is a cross-sectional view of the plasma tube along a line VIIB-VIIB in FIG. 7A.

FIG. 7A is a cross-sectional view of part of one of plasma tube or gas discharge tubes 11 (11R, 11B or 11G) of FIG. 6 along a line VIIA-VIIA in FIG. 6. FIG. 7B is a cross-sectional view of the plasma tube 11 along a line VIIB-VIIB in FIG. 7A.

The support member 6 has a curved surface shape or contour generally conformable to the inner surface of the plasma tube 11 so as to provide a discharge space inside. The curved surface of the support member 6 forms, together with the end walls 602 on the opposite ends of the support member 6, a trough having an elongated recess, depression or discharge space therein.

The plasma tube 11 has outer walls 112 at its longitudinally opposite ends. The thickness of each outer walls 112 is generally the same as that of the thin tube 20 of the plasma tube 11 (FIG. 1) or may be slightly larger. The thickness of the outer wall 112 may be, for example, within a range of from 0.1 mm to 0.15 mm. The thickness Tw of each end wall 602 of the support member 6 is generally the same as the thickness of the remaining portions of the support member 6 or may be slightly larger. The thickness of the end wall 602 may be, for example, within a range of from 0.1 mm to 0.15 mm.

The upper edge 602*te* of each end wall 602 is generally leveled vertically with the upper edge 6*te* of the support member 6 extending in the length direction of the support member 6, as illustrated in FIG. 7A.

The presence of the end walls 602 can prevent the phosphor layer 4 from peeling off in the vicinity of the ends of the support member 6, even when the ends of the support member 6 or its end walls 602 contacts, rubs against or hits against other members, e.g. the interior surface or the outer walls 112 of the plasma tube 11. Furthermore, the presence of the end walls 602 can prevent or suppress increase of the firing voltage of the discharge cells near the end walls 602, which may be caused by peeling off of part of the phosphor layer 4. This can prevent decrease in brightness or luminosity in the vicinity of the ends of the plasma tube 11, which may be caused by peeling off of the phosphor layer 4 in the end portions of the support member 6.

Each end wall 602 is made of the same material as the support member 6 or of a glass material having a low melting point, and is secured to the support member 6 by fusing a separate glass chip in the shape of the end wall 602, directly or with a glass material having a low melting point interposed to the inner surface of the associated end of the support member 6.

Figure 8A:
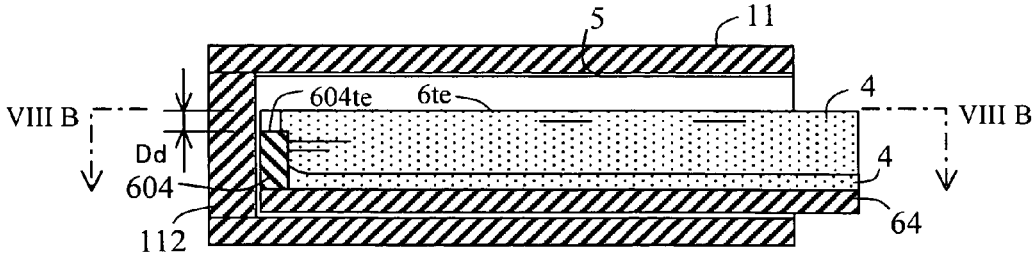
FIG. 8A illustrates a modification of the plasma tube of FIGS. 7A and 7B, and is a cross-sectional view of part of a modification of a plasma tube along a line VIIIA-VIIIA in FIG. 8B, in accordance with another embodiment of the invention.
Figure 8B:
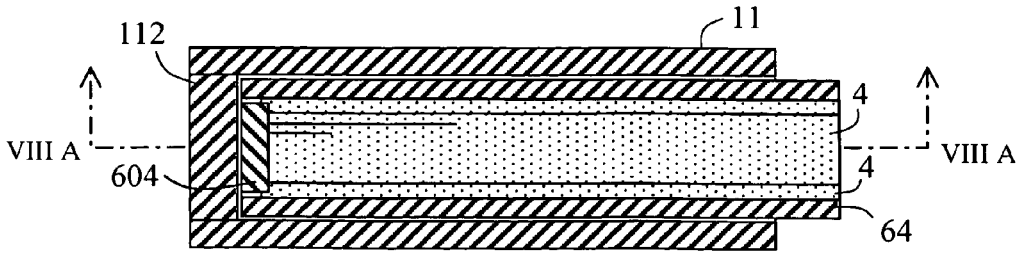
FIG. 8B is a cross-sectional view of the plasma tube of FIG. 8A along a line VIIIB-VIIIB in FIG. 8A.

FIG. 8A illustrates a modification of the plasma tube 11 of FIGS. 7A and 7B, and is a cross-sectional view of part of a plasma tube 11 along a line VIIIA-VIIIA in FIG. 8B, in accordance with another embodiment of the invention. FIG. 8B is a cross-sectional view of the plasma tube 11 of FIG. 8A along a line VIIIB-VIIIB in FIG. 8A.

An end wall 604 having a generally similar shape to that of the end walls 602 illustrated in FIGS. 6, 7A and 7B is disposed at each end of a support member 64 within the plasma tube 11. The vertical position or level of an upper edge 604*te* of the end wall 604 in FIG. 8A is lower by a difference Dd (e.g., 0.1 mm) than the vertical position or level of the upper edge 6*te* of the support member 64. This arrangement reduces the influence of variations in dimensions of the end walls 604 on the dimensions of the opposite ends of the support member 64. Since the entire dimensions of the support member 64 are so determined as to conform to the internal dimensions of the plasma tube 11, it is not desirable, from a view point of the structure of the plasma tube 11, that the entire or even part of the end walls 604 is larger. In FIG. 6, the position of the upper edge 604*te* of the end wall 604 in a bottom view of the array of plasma tubes 11 is illustrated slightly lower by broken lines, as opposed to the upper edge 602*te* of the end wall 602. The remaining structure and arrangement of the support member 64 are similar to the ones of the support member 6 illustrated in FIGS. 6, 7A and 7B.

The presence of the end walls 604 can prevent the phosphor layer 4 from peeling off in the vicinity of the ends of the support member 64, even when the ends of the support member 64 or its end walls 604 contacts, rubs against or hits against other members, e.g. the interior surface or the outer walls 112 of the plasma tube 11. Furthermore, the presence of the end walls 604 can prevent or suppress increase of the firing voltage of the discharge cells near the end walls 604, which may be caused by peeling off of part of the phosphor layer 4. This can prevent decrease in brightness or luminosity in the vicinity of the ends of the plasma tube 11, which may be caused by peeling off of the phosphor layer 4 in the end portions of the support member 64.

Figure 9A:
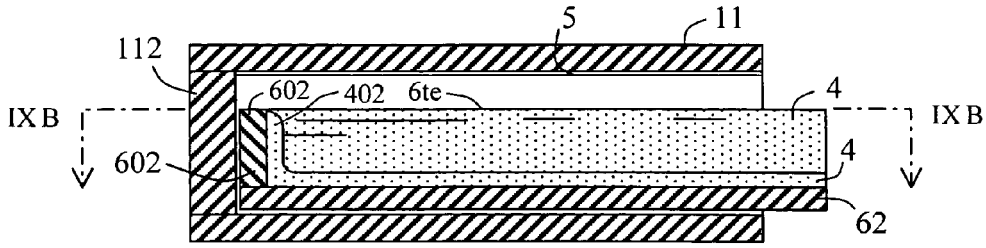
FIG. 9A illustrates another modification of the plasma tube of FIGS. 7A and 7B, and is a cross-sectional view of part of a plasma tube of FIG. 9B in accordance with a further embodiment of the invention along a line IXA-IXA in FIG. 9B.
Figure 9B:
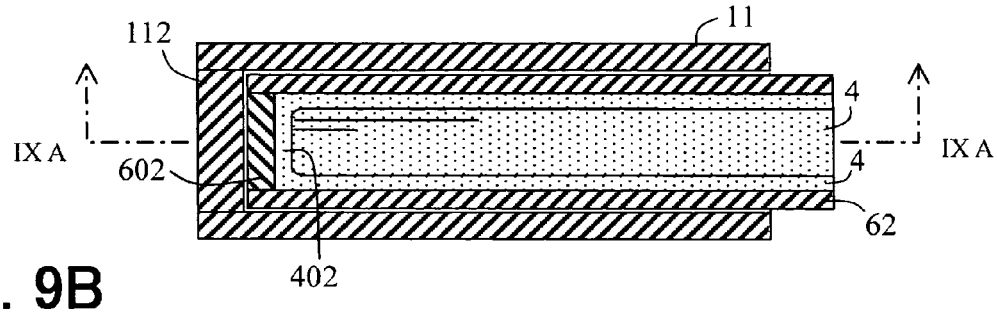
FIG. 9B is a cross-sectional view of the plasma tube of FIG. 9A along a line IXB-IXB in FIG. 9A.

FIG. 9A illustrates another modification of the plasma tube 11 of FIGS. 7A and 7B, and is a cross-sectional view of part of a plasma tube 11 along a line IXA-IXA in FIG. 9B, in accordance with a further embodiment of the invention. FIG. 9B is a cross-sectional view of the plasma tube 11 of FIG. 9A along a line IXB-IXB in FIG. 9A.

An end wall 602 similar to the one illustrated in FIGS. 6, 7A and 7B is disposed at each of the opposite ends of a support member 62 within the plasma tube 11. A phosphor layer 402 having generally the same thickness as a phosphor layer 402 on the inner surface of the support member 62 is formed on the inner surface of each end wall 602. The phosphor layer 402 can be formed on the end walls 602 simultaneously with the formation of the phosphor layer 4 on the inner surface of the support member 62.

The presence of the end walls 602 can prevent the phosphor layer 402 on the inner surface of each end wall 602 and the phosphor layer 4 in the vicinity of the ends of the support member 62 from peeling off, even when the ends of the support member 62 or its end walls 602 contacts, rubs against or hits against other members. Furthermore, the presence of the end walls 602 can prevent or suppress increase of the firing voltage of the discharge cells near the end walls 602, which may be caused by peeling off of part of the phosphor layer 4. This can prevent decrease in brightness or luminosity in the vicinity of the ends of the plasma tube 11, which may be caused by peeling off of the phosphor layer 4 in the end portions of the support member 62.

In the embodiment illustrated in FIGS. 6, 7A and 7B, the internal discharge space near each end of the support member 6 in the plasma tube 11 is relatively small due to the presence of the outer wall 112 of the plasma tube 11 and the end wall 602, and the phosphor layer 4 does not extend beyond the display electrode 2 nearest to the end of the support member 6. This tends to cause reduction of amount of light emitted by discharging so that the brightness or luminosity decreases near each end of the support member 6. In contrast, when the support member 62 in the embodiment illustrated in FIGS. 9A and 9B are used, the presence of the phosphor layer 402 allows the area of the phosphor layer near each end wall 602 to be increased, whereby sufficient light emission based on discharging in the internal discharge space in the vicinity of the end of the support member 62 can be secured, which can sufficiently suppress and compensate the reduction of the brightness.

Figure 10A:
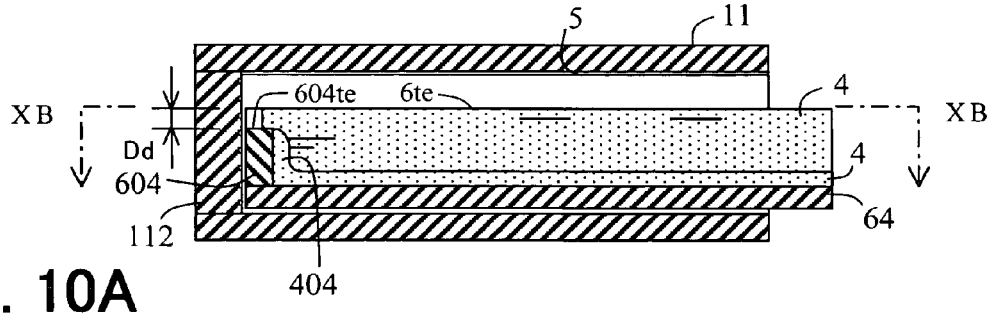
FIG. 10A illustrates a modification of the plasma tube of FIGS. 8A and 8B and FIGS. 9A and 9B, and is a cross-sectional view of part of a plasma tube of FIG. 10B, in accordance with a still further embodiment of the invention along a line XA-XA in FIG. 10B.
Figure 10B:
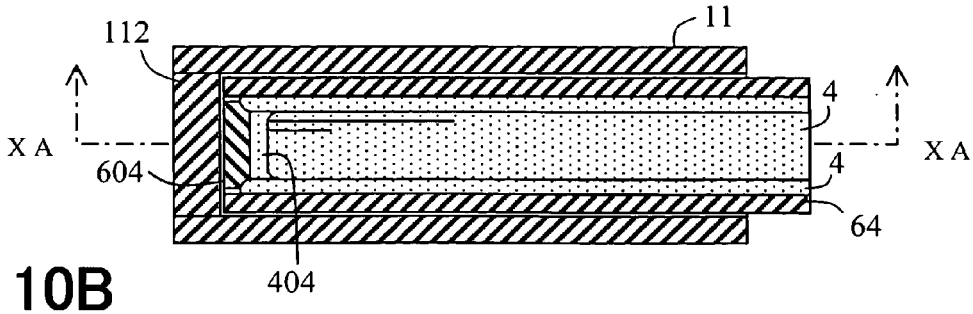
FIG. 10B is a cross-sectional view of the plasma tube of FIG. 10A along a line XB-XB in FIG. 10A.

FIG. 10A illustrates a modification of the plasma tube 11 of FIGS. 8A and 8B and FIGS. 9A and 9B, and is a cross-sectional view of part of a plasma tube 11 along a line XA-XA in FIG. 10B, in accordance with a still further embodiment of the invention. FIG. 10B is a cross-sectional view of the plasma tube 11 of FIG. 10A along a line XB-XB in FIG. 10A.

An end wall 604 having dimensions similar to the ones of the end wall 604 illustrated in FIGS. 8A and 8B is provided at each of the opposite ends of a support member 64 within the plasma tube 11. This arrangement reduces the influence of variations in dimensions of the end walls 604 on the dimensions of the opposite ends of the support member 64. Similarly to the phosphor layer 402 illustrated in FIGS. 9A and 9B, a phosphor layer 404 having generally the same thickness as a phosphor layer 4 on the inner surface of the support member 64 is formed on the inner surface of each end wall 604. The phosphor layer 404 can be formed on the end walls 602 simultaneously with the formation of the phosphor layer 4 on the inner surface of the support member 64.

The presence of the end walls 604 can prevent the phosphor layers 404 on the inner surface of each end wall 604 and the phosphor layer 4 in the vicinity of the ends of the support member 64 from peeling off, even when the ends of the support member 64 or its end walls 604 contacts, rubs against or hits against other members. Furthermore, the presence of the end walls 604 can prevent or suppress increase of the firing voltage of the discharge cells near the end walls 604, which may be caused by peeling off of part of the phosphor layer 4. This can prevent decrease in brightness or luminosity in the vicinity of the ends of the plasma tube 11, which may be caused by peeling off of the phosphor layer 4 in the end portions of the support member 64.

In the embodiment illustrated in FIGS. 8A and 8B, the internal discharge space near each end of the support member 64 in the plasma tube 11 is relatively small due to the presence of the outer wall 112 of the plasma tube 11 and the end wall 604, and the phosphor layer 4 does not extend beyond the display electrode 2 nearest to the end of the support member 64. This tends to cause reduction of amount of light emitted by discharging so that the brightness or luminosity decreases near each end of the support member 64. In contrast, when the support member 64 in the embodiment illustrated in FIGS. 10A and 10B are used, the presence of the phosphor layer 404 allows the area of the phosphor layer near each end wall 604 to be increased, whereby sufficient light emission based on discharging in the internal discharge space in the vicinity of the end of the support member 64 can be secured, which can sufficiently suppress and compensate the reduction of the brightness.

Figure 11A:
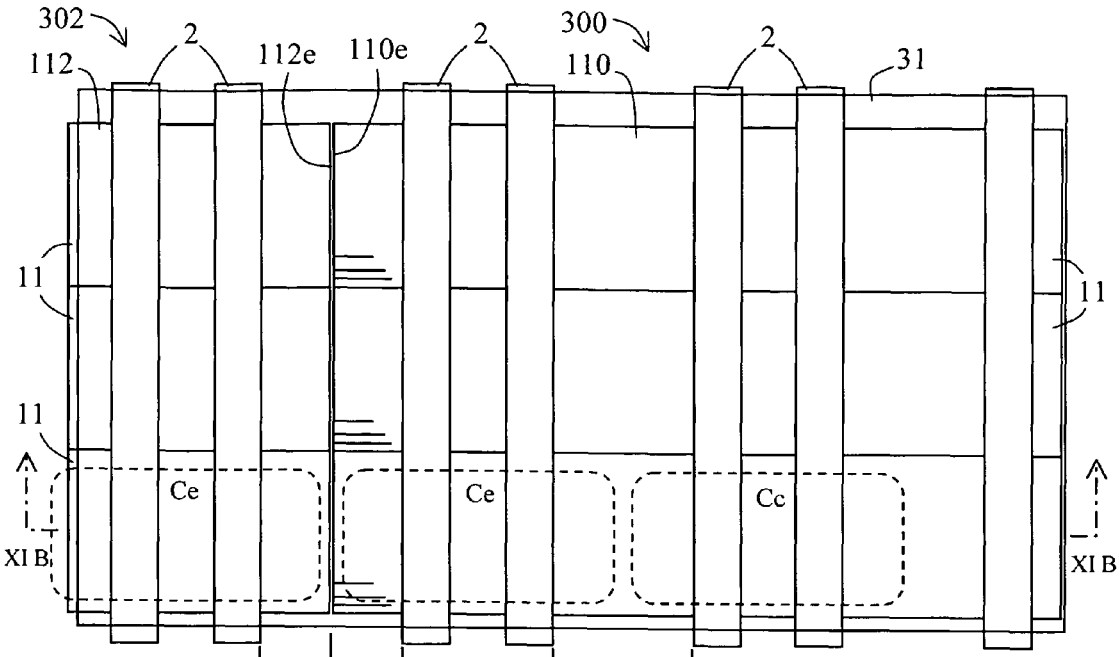
FIG. 11A is a schematic plan view of part of an array of plasma tubes or gas discharge tubes, in accordance with a further embodiment of the invention.
Figure 11B:
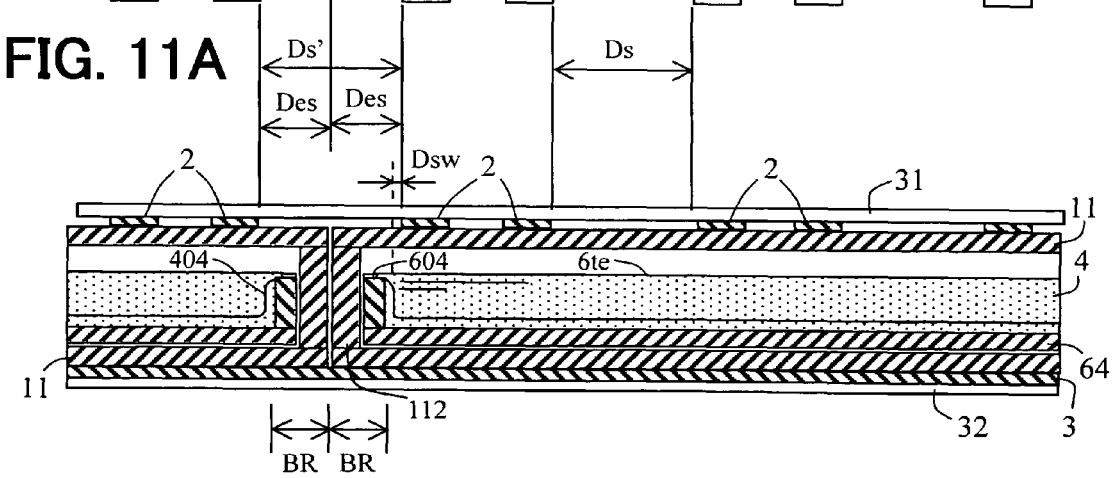
FIG. 11B is a cross-sectional view the array of the plasma tubes or gas discharge tubes of FIG. 11A along a line XIB-XIB.

FIG. 11A is a schematic plan view of part of an array of plasma tubes or gas discharge tubes 11, in accordance with a further embodiment of the invention. FIG. 11B is a cross-sectional view the array of the plasma tubes or gas discharge tubes 11 illustrated in FIG. 11A along a line XIB-XIB.

An end wall 604 and a phosphor layer 404 having dimensions similar to the ones of the end wall 604 and the phosphor layer 404 illustrated in FIGS. 10A and 10B are disposed at each of the opposite ends of the support member 64 in the plasma tube 11.

Alternatively, the plasma tubes illustrated in FIGS. 7A and 7B, 8A and 8B, or 9A and 9B may be used for the plasma tubes 11 in FIGS. 11A and 11B.

The sum of the thickness of the end wall 604 and the thickness of the outer wall 112 is, for example, between 0.2 mm and 0.6 mm. Accordingly, the sum thickness of the two end walls 604 and the two outer walls 112 at the joint of the two adjacent PTA units 300 and 302 of FIGS. 11A and 11B in place of those of FIG. 5 is, for example, between 0.4 mm and 1.2 mm.

A region BR (e.g., a distance of BR=0.5 mm) in the vicinity of the outer wall 112 of the plasma tube 11 and the end wall 604 of the support member 64 does not contribute to discharging for display.

In order to provide a sufficient discharge space inside the support member 64 to thereby produce a sufficient spatial charge, the outer edge of the display electrode 2 is preferably located inward, in the length direction of the plasma tube 11, by at least a small distance Dsw (e.g., between about 10 μm and about 50 μm) from the inner surface of the end wall 604 (602).

A width Des of an end non-discharge region, between the outer surface of the outer wall 112 of the plasma tube 11 and the outer edge of the display electrode 2 in the vicinity of the end of the plasma tube 11, is preferably smaller than a so-called reverse or spacing slit width or non-discharge region width Ds between adjacent pairs of display electrodes 2, and is, for example, between 0.4 mm and 6 mm. Generally, the width Des of the end non-discharge region is preferably half or slightly smaller than the width Ds (e.g., between 0.9 mm and 1.5 mm) of the non-discharge region. This prevents picture distortion at the joint between the arrays of plasma tubes 11 or between the PTAs 110 and 112 of the adjacent PTA units 300 and 302.

The distance Ds' between the display electrodes 2 closest to the joint between the two arrays of plasma tubes 11 adjacent in the length direction preferably is substantially equal to the width Ds of the non-discharge region between the adjacent pairs of display electrodes 2 for each plasma tube 11. This prevents picture distortion at the joint between adjacent PTA units 300 and 302.

When a plurality of plasma tubes or gas discharge tubes 11 like the ones illustrated in FIGS. 11A and 11B are used to form the PTA units 300 and 302 similarly to those of FIG. 5, the plasma tubes 11 are so arranged that first ends 110*e* of a first group of plasma tubes or gas discharge tubes 110 of one 300 of the adjacent two PTA units 300 and 302 abut second ends 112*e* of a second group of plasma tubes or gas discharge tubes 112 of the other PTA unit 302.

The distance Ds' between the display electrode 2 closest to the first ends 110*e* of the first group of plasma tubes 110 and the display electrode 2 closest to the second ends 112*e* of the second group of plasma tubes 112 is substantially equal to the distance Ds between adjacent two pairs of display electrodes of each plasma tube 11 of the first or second group of plasma tubes 110 or 112.

The region BR (e.g., a distance of BR=0.5 mm) in the vicinity of the outer wall 11 of the plasma tube 11 and the end wall 604 of the support member 64 does not contribute to discharging for display. However, by virtue of the presence of the phosphor layer 404 on the inner surface of the end wall 604, a discharge cell Ce in the vicinity of the end wall 604 of the support member 64 can provide generally the same luminosity as other discharge cells Cc. The phosphor layers 402 on the end walls 602 of the support members 62 of FIGS. 9A and 9B bring about the same effect.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A gas discharge tube, comprising:

an elongated tube within which an electron-emissive film is formed, the elongated tube being filled with a discharge gas and sealed and having an outer wall at one or both of longitudinally opposite ends thereof;

a plurality of pairs of display electrodes disposed on a display side of the elongated tube;

a signal electrode disposed on a rear side of the elongated tube; and an elongated support member inserted into the elongated tube, the support member extending in the length direction of the elongated tube;

the support member having a curved shape so that a curved inner surface thereof forms a discharge space, having longitudinally extending opposite edges, and having an end wall, which is different from the one or both outer walls of the elongated tube, at one or each of longitudinally opposite ends of the support member, the one or each end walls and the curved inner surface forming an elongated depression in the support member, the support member further having a phosphor layer formed on the curved inner surface and on an inner surface of the one or both end walls.

2. The gas discharge tube according to claim 1, wherein a height of each of the end walls measured in a direction perpendicular to the length of the support member is lower than a height of the longitudinally extending opposite edges measured in the direction perpendicular to the length of the support member.

3. The gas discharge tube according to claim 2, wherein one of the display electrodes in the pairs that is closest to each of the end walls is located longitudinally inward of the inner surface of that end wall.

4. The gas discharge tube according to claim 2, further comprising an outer wall at each of longitudinally opposite ends of the elongated tube;

a distance between one of the display electrodes in sa pair that is closest to one of the outer walls and an outer surface of that outer wall being smaller than a distance between adjacent pairs of display electrodes.

5. The gas discharge tube according to claim 1, wherein one of the display electrodes in the pairs that is closest to each of the end walls is located longitudinally inward of the inner surface of that end wall.

6. The gas discharge tube according to claim 5, further comprising an outer wall at each of longitudinally opposite ends of the elongated tube;

a distance between one of the display electrodes in a pair that is closest to one of the outer walls and an outer surface of that outer wall being smaller than a distance between adjacent pairs of display electrodes.

7. The gas discharge tube according to claim 1, further comprising an outer wall at each of longitudinally opposite ends of the elongated tube;

a distance between one of the display electrodes in pair that is closest to one of the outer walls and an outer surface of that outer wall being smaller than a distance between adjacent pairs of display electrodes.

8. The gas discharge tube according to claim 7, wherein the distance between the one display electrode and the outer surface of the one outer wall is not greater than half of the distance between adjacent display electrode pairs.

9. A display device comprising an array of gas discharge tubes arranged side by side, each gas discharge tube comprising:

an elongated tube within which an electron-emissive film is formed, the elongated tube being filled with a discharge gas and sealed and having an outer wall at one or both of longitudinally opposite ends thereof, a plurality of pairs of display electrodes disposed on a display side of the elongated tube, a signal electrode disposed on a rear side thereof, and an elongated support member inserted into the elongated tube, the support member extending in the length direction of the elongated tube, the support member having a curved shape so that a curved inner surface thereof forms a discharge space, having longitudinally extending opposite edges, and having an end wall, which is different from the one or both outer walls of the elongated tube, at one or each of longitudinally opposite ends of the support member, the one or each end walls and the curved inner surface forming an elongated depression in the support member, the support member further having a phosphor layer formed on the curved inner surface and on an inner surface of the one or both end walls;

the display device further comprising a pair of support plates or sheets disposed on the display and rear sides of the array of gas discharge tubes to sandwich the array of gas discharge tubes therebetween, the pairs of display electrodes and the signal electrodes for applying a voltage to the gas discharge tubes being formed on those surfaces of associated ones of the support plates or sheets which face the array of gas discharge tubes.

10. The display device according to claim 9, wherein a distance between one of the display electrodes in the pairs that is closest to one of the outer walls and an outer surface of the one outer wall being smaller than a distance between adjacent two of the plurality of pairs of display electrodes of each gas discharge tube, wherein one display electrode of the pairs of display electrodes that is closest to each of the end walls is located longitudinally inward of the inner surface of that end wall.

11. A display device comprising a plurality of units, each unit comprising a plurality of gas discharge tubes arranged side by side, each of the gas discharge tubes being filled with a discharge gas, and having fan outer wall at one or both of longitudinally opposite ends thereof, each of the units further comprising a plurality of pairs of display electrodes arranged on a display side of the plurality of gas discharge tubes, and a plurality of signal electrodes arranged on a rear side of the plurality of gas discharge tubes;

first ends of a first group of gas discharge tubes in one of adjacent two of the units contacting second ends of a second group of gas discharge tubes in the other of the adjacent two units;

an elongated support member being inserted into each of the gas discharge tubes;

the support member having a curved shape so that a curved inner surface thereof forms a discharge space, having longitudinally extending opposite edges, and having a phosphor layer formed on the curved inner surface of the support member and an end wall, which is different from the one or both outer walls of the elongated tube, at one or each of longitudinally opposite ends of the support member, the end wall and the curved inner surface forming an elongated depression in the support member, the support member further having a phosphor layer formed on the curved inner surface and on an inner surface of the one or both end walls;

a distance between the display electrode closest to the first ends of the first group of gas discharge tubes and the display electrode closest to the second ends of the second group of gas discharge tubes being substantially equal to a distance between adjacent two pairs of display electrodes on the first or second group of gas discharge tubes.

12. A display device, comprising:

an array of elongated plasma tubes arranged side by side, each elongated plasma tube having an outer wall at one or both of longitudinally opposite ends thereof and including an elongated phosphor support member inserted therein having a generally U shaped or C shaped cross-section in perpendicular to a length thereof, the elongated phosphor support member further having an end wall, which is different from the one or both outer walls of the elongated tube, at one or each of longitudinally opposite ends thereof, and a phosphor layer formed on an inner surface of the elongated phosphor support member, including the inner surface of the end wall at the one or each of the opposite ends of the elongated phosphor support member.

13. A display device, comprising:

a plurality of units, each unit including an array of gas discharge tubes arranged side by side, the units including two adjacent units of first and second arrays of gas discharge tubes, respectively, the first array of gas discharge tubes having, on a first side thereof, a first group of sealed outer ends of the gas discharge tubes, the second array of gas discharge tubes having, on a second side thereof, a second group of sealed outer ends of the gas discharge tubes facing the first group of sealed outer ends, and each gas discharge tube having an outer wall at one or both of longitudinally opposite ends thereof and an elongated phosphor support member inserted therein, each elongated phosphor support member having a generally U-shaped or C-shaped cross-section in perpendicular to a length thereof, and having an end wall, which is different from the one or both outer walls of the elongated tube, at one of opposite ends thereof inwardly adjacent to the sealed outer end of a corresponding gas discharge tube, a phosphor layer being formed on an inner surface of each elongated phosphor support member, including the inner surface of the end wall thereof.

* * * * *

UNITED STATES PATENT AND TRADEMARK OFFICE

CERTIFICATE OF CORRECTION

PATENT NO. : 7,902,735 B2
APPLICATION NO. : 12/232753
DATED : March 8, 2011
INVENTOR(S) : Bingang Guo et al.

It is certified that error appears in the above-identified patent and that said Letters Patent is hereby corrected as shown below:

Column 11, Line 42 in Claim 4, delete “sa” and insert -- a --, therefor.

Column 11, Line 60 in Claim 7, delete “in pair” and insert -- in a pair --, therefor.

Column 12, Line 47, in Claim 11, delete “fan” and insert -- an --, therefor.

Signed and Sealed this
Tenth Day of May, 2011

David J. Kappos

David J. Kappos
*Director of the United States Patent and Trademark Office*